US005092730A

United States Patent [19]

Neri

[11] Patent Number: 5,092,730

[45] Date of Patent: Mar. 3, 1992

[54] APPARATUS FOR FEEDING PACKAGING MACHINES WITH STACKS OF SHEET MATERIAL

[75] Inventor: Armando Neri, Bologna, Italy

[73] Assignee: G.D. S.p.A., Bologna, Italy

[21] Appl. No.: 558,365

[22] Filed: Jul. 27, 1990

[30] Foreign Application Priority Data

Aug. 1, 1989 [IT] Italy ..... 3577 A/89

[51] Int. Cl.[5] ..... B65G 67/02

[52] U.S. Cl. ..... 414/331; 211/121; 414/392; 414/622

[58] Field of Search ..... 414/331, 787, 416, 391, 414/392, 399, 622, 626, 795.8, 796.6; 195/797; 211/121

[56] References Cited

U.S. PATENT DOCUMENTS

| | | | |
|---|---|---|---|
| 2,829,780 | 4/1958 | Boor | 211/121 |
| 3,075,656 | 1/1963 | Pearne | 414/391 X |
| 3,133,655 | 5/1964 | Gardner | 414/622 X |
| 3,517,831 | 6/1970 | Hahn | 414/416 X |
| 3,797,687 | 3/1974 | Silva | 414/622 X |
| 3,884,363 | 5/1975 | Ajlouny | 414/626 |
| 4,773,810 | 9/1988 | Nishimura et al. | 414/331 |
| 4,787,810 | 11/1988 | Cawley et al. | 414/622 X |
| 4,854,815 | 8/1989 | Augst | 414/795.8 X |
| 4,907,941 | 3/1990 | Folke et al. | 414/795.8 |
| 4,917,559 | 4/1990 | van der Schoot | 414/331 |

FOREIGN PATENT DOCUMENTS

| | | | |
|---|---|---|---|
| 45826 | 3/1986 | Japan | 414/416 |
| 51509 | 3/1987 | Japan | 414/626 |
| 2047663 | 12/1980 | United Kingdom . | |

*Primary Examiner*—David A. Bucci

*Attorney, Agent, or Firm*—Guido Modiano; Albert Josif

[57] ABSTRACT

The apparatus for feeding packaging machines with stacks of sheet material includes a trolley-like support provided with a vertically arranged rotatable belt having orthogonally connected thereto a plurality of pairs of support walls which define an accommodation seat for respective stacks of material in sheets, and a unit for removing and transferring the stacks which has a head provided with an element for gripping a stack. The head is movable vertically, laterally and horizontally so as to arrange itself at a selected accommodation seat in order to remove a stack therefrom and subsequently move it to a station for feeding the material in sheets to the packaging machine. The pairs of support walls are relatively mutually displaceable along a horizontal axis to thereby support a stack in a closed position and release a stack, or alternatively to receive a stack, in an open position.

9 Claims, 3 Drawing Sheets

APPARATUS FOR FEEDING PACKAGING MACHINES WITH STACKS OF SHEET MATERIAL

BACKGROUND OF THE INVENTION

The present invention relates to an apparatus for feeding packaging machines with stacks of sheet material, in particular cardboard cutouts for rigid cigarette packets.

As known, cigarette packaging machines are fed with stacks of cardboard cutouts intended to constitute the outer container of the packets.

The stacks of cardboard cutouts are arranged on a belt conveyor which advances with a stepwise motion so as to convey said stacks to means which transfer the individual cardboard cutouts to a processing line of the machine.

The stacks of cutouts are currently arranged manually on the input conveyor of the packaging machine.

The conveyor in turn feeds a tank or hopper which feeds a stripper element suitable for separating the individual cutouts to be transferred to the machine processing line.

This feeding system is rather complicated and limits the productivity of the machine, besides entailing a considerable labor cost.

SUMMARY OF THE INVENTION

The aim of the present invention is to solve the above described problem by means of an apparatus which allows to feed packaging machines with stacks of cardboard cutout in a completely automatic manner.

A further object of the present invention is to provide an apparatus which is simple in concept, safely reliable in operation and versatile in use.

According to the present invention, an apparatus is provided for feeding packaging machines with stacks of sheet material, characterized in that it comprises trolley-like supporting means provided with distribution means which have a plurality of supporting means, each of which is suitable for defining a seat for the accommodation of a stack, a unit for removing and transferring said stacks, provided with a movable head, a grip element for a stack supported by said head, said head being suitable for arranging itself at an accommodation seat and for subsequently moving to a feeding station of said packaging machine.

BRIEF DESCRIPTION OF THE DRAWINGS

Further characteristics and advantages will become apparent from the detailed description of a preferred embodiment of the invention, shown in the accompanying illustrative, non limitative drawings, wherein.

DESCRIPTION OF THE PREFERRED EMBODIMENTS

Figures 1, 4:
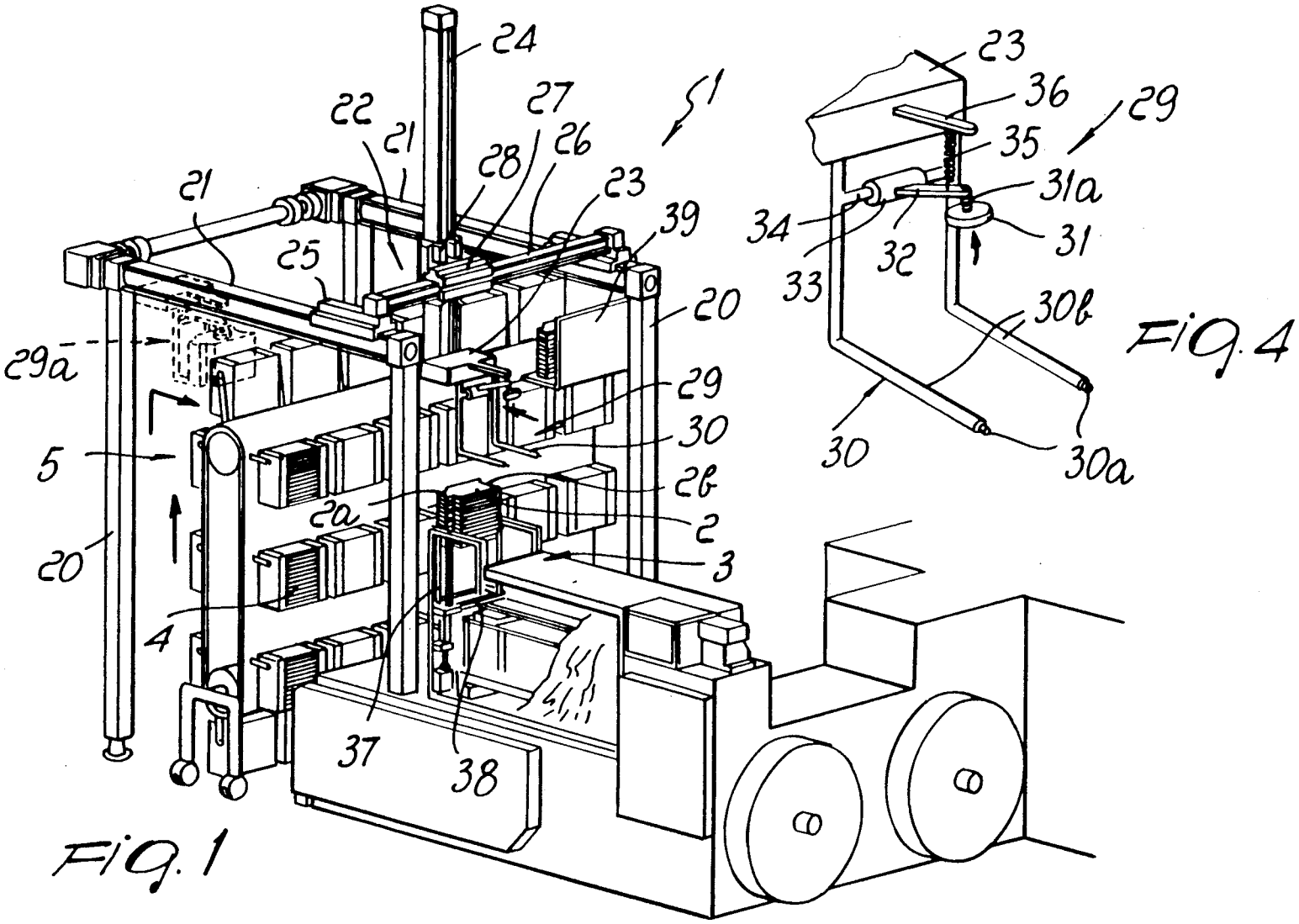
FIG. 1 is a perspective view of the apparatus for feeding packaging machines.
FIG. 4 is a detailed view of a detail of FIG. 1.

With particular reference to the above figures, the reference numeral 1 generally indicates an apparatus which allows to automatically feed stacks of cardboard cutouts 2 to a hopper 3 which constitutes a station for feeding said cutouts to a conventional packaging machine.

The cardboard cutouts 2 have a substantially rectangular shape which has, at its ends, respectively a tab **2*a* and a trapezoidal indent 2*b*; the cutouts 2** furthermore have appropriate folding and cutting lines suitable for allowing the subsequent packaging operations.

Figure 2:
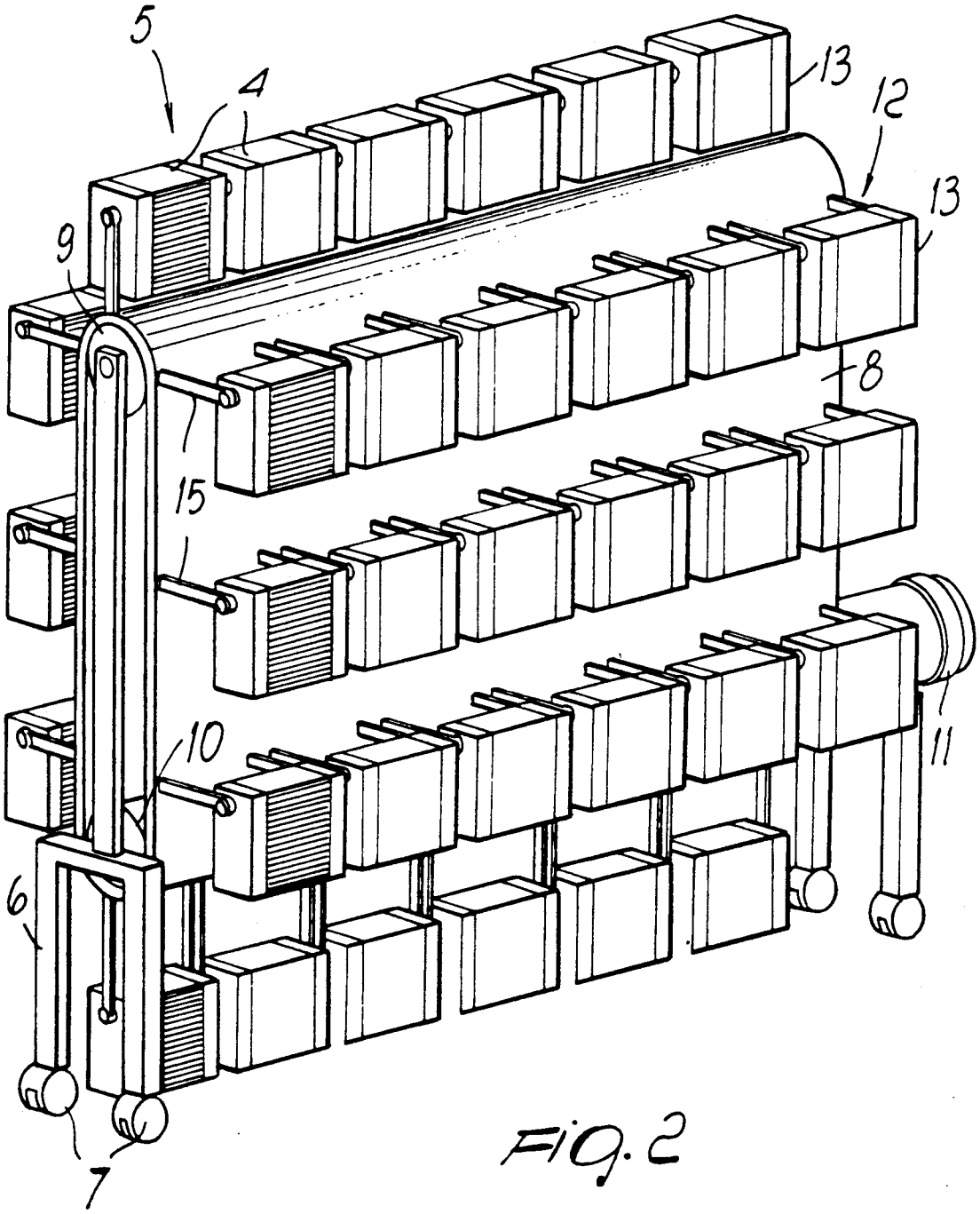
FIG. 2 is a perspective view of the trolley-like supporting means.

The cutouts 2 are supplied in stacks 4 which, according to what is illustrated in detail in FIG. 2, are arranged in an orderly manner on trolley like supporting means 5.

The trolley comprises a frame 6 which is mounted on wheels 7 and supports distribution means advantageously comprising a belt 8.

The belt 8 wraps around a pair of respectively upper and lower rollers 9 and 10 which are supported by the frame 6 so as to be horizontally parallel and co-planar.

The belt 8 is suitable for being actuated by a motor element means 11 which is supported by said frame 6.

A plurality of stack supporting means, indicated by 12, is distributed on the belt 8 in parallel rows.

Figure 3:
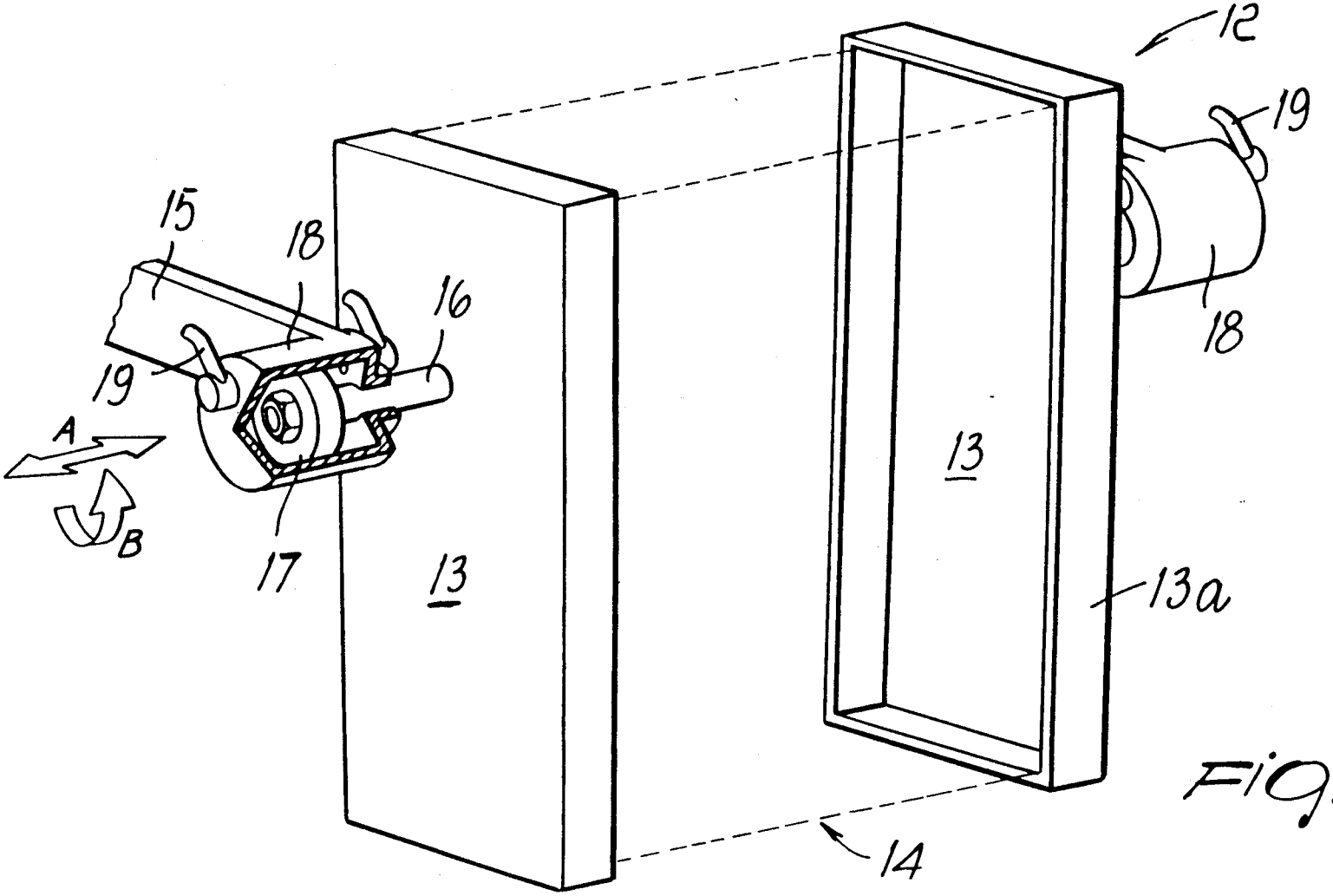
FIG. 3 is a detailed view of a detail of FIG. 2.

Each supporting means 12 has a pair of opposite walls 13 which are suitable for defining an accommodation seat 14 for a related stack 4 (FIG. 3).

The walls 13 have edges **13*a* intended to retain the longitudinal ends of the cardboard cutouts 2 at the tabs 2*a* and at the indents 2*b***.

The walls 13 are supported in an oscillating manner, about axes which are parallel to the axes of the rollers 9 and 10, by the ends of respective arms 15 which are rigidly associated with the belt 8, perpendicular to its surface.

It should be noted that the arms 15 engage an upper region of the walls 13, so that the supporting means 12 maintain a stable vertical arrangement during the movement of the belt 8.

In a preferred embodiment, illustrated in FIG. 3, the axis of rotation of each supporting means 12 is constituted by stems 16 fixed to the outside of the two walls 13.

Each stem 16 is subjected to the action of axial movement means. Said means advantageously comprise a hollow cylinder 18 which is rigidly associated with the end of an arm 15, by a piston 17 which is rigidly associated with the stem 16 and is slidable within the cylinder 18, and by pneumatic ducts 19 for feeding the cylinder 18 which are suitable for causing the axial sliding of the piston 17 in both directions.

As a consequence of the above, the stems 16, with the related pistons 17, cylinders 18 and pneumatic ducts 19, constitute means for opening and closing the two walls 13 of each accommodation seat 14.

The walls 13 can therefore move laterally and oscillate on the axis of the stem 16, as indicated by the arrows A and B in FIG. 3.

The apparatus 1 has a fixed frame means which advantageously comprises two pairs of uprights 20 which rise symmetrically along the vertices of a quadrilateral; the uprights 20 have, at their top, a pair of beams 21 which are arranged horizontally parallel.

A unit for removing and transferring the stacks 4, generally indicated by 22, is horizontally movable on the beams 21.

The removal and transfer unit 22 has a head 23 mounted at the lower end of a vertical beam 24.

The beams 21 slidably support respective sliders 25 which are connected to one another by a cross-member 26 and can be actuated by means of actuator elements (not illustrated).

The cross-member 26 slidably supports a sleeve 27 which can be actuated by an appropriate actuation element (not illustrated); a further sleeve 28 is rigidly associated with the sleeve 27 and is perpendicular thereto; the vertical beam 24, which can be actuated by a related actuator element (not illustrated), is slidably mounted therein.

The removal head 23 has a grip element means 29 which is substantially clamp-shaped and is illustrated in detail in FIG. 4.

The grip element 29 has a sort of fork 30 provided with two tines 30*b* which extend downward with respect to the head 23.

The tines 30*b* are bent at right angles so as to be insertable under the stack 4 to be removed.

The tines 30*b* of the fork 30 preferably have, at their end, respective optical empty-space sensors 30*a* which are intended to provide a signal enabling the insertion of the grip element 29 under the stack 4.

A presser element 31 is suitable for cooperating with the fork 30 and is mounted in an oscillating manner in an upward and substantially median position with respect to the tines 30*b*.

The presser 31 is supported, by virtue of elastic means advantageously constituted by a helical spring 31*a*, at the end of an arm 32 which extends radially from a sleeve 33.

The sleeve 33 is rotatable, under the action of an appropriate actuation element (not illustrated), on a stem 34 which is transverse with respect to the fork 30.

The arm 32 is elastically recalled by a helical spring 35 which is fixed to an upper coupling 36 which is rigidly associated with the head 23 and is suitable for acting against the securing action of the presser 31.

The operation of the described device is as follows.

The stacks 4 of cutouts 2 to be transferred to the packaging machine are inserted by the operator in the accommodation seats 14 defined by the related supporting means 12 on the trolley 5.

For this purpose, the walls 13 are opened by virtue of actuation means (not illustrated) which act on the pneumatic cylinders 18.

The mutual spacing of the walls 13 allows the insertion of the stack 4.

The walls 13 are then moved back together, again by the pneumatic cylinders 18, so as to secure said stack 4 therebetween.

It is naturally possible to provide the automatic execution of said step of filling all the accommodation seats 14 of the trolley 5 by means of appropriately provided devices.

The trolley 5, on which the stacks 4 are arranged in an orderly manner, is inserted at the base of the apparatus 1.

In this position the trolley 5 is arranged below the removal and transfer unit 22 which is movable on the cross-members 21.

In particular, the removal head 23 is movable along three orthogonal axes and can therefore be arranged exactly at the first stack 4 to be transferred and subsequently lowered in front of said stack.

The movements of the head 23 are conveniently controlled by an appropriate electronic control unit (not illustrated) of a known and commercially available type normally used in three-axis measurement machines.

The fork 30 is caused to advance so as to insert its tines 30*b* under the stack 4 in the region comprised between the edges 13*a*.

The lowering of the presser 31 is then actuated, and said presser elastically clamps the stack 4 so as to support the stack during the opening of the walls 13. Said opening, which is controlled by known enabling means (not illustrated), is performed by means of the pneumatic cylinders 18.

The stack 4, removed by the grip element 29, is raised above the trolley 5, as indicated by the broken line 29*a* (FIG. 1) and then moved in the transfer direction C, which is parallel to the beams 21, until it is above the feed hopper 3.

The stack 4 is then lowered and inserted in the hopper 3 and released by the grip element 29.

It should be noted that during the transfer step the stack 4 is arranged with the longer sides of the cutouts 2 horizontally perpendicular to the direction C.

The hopper 3 is constituted by a plurality of angular profiled elements 37 which are arranged vertically according to the vertices of a rectangle and are suitable for guiding the stack 4; the profiled elements 37 extend from a frame 38 which supports the stack 4 and is arranged above a per se known stripper element suitable for separating the individual cutouts 2 of the stack to be transferred to the processing line of the packaging machine.

Removal from the trolley 5 and transfer to the feed hopper 3 of the other stacks 4, arranged within the accommodation seats 14 which belong to a same row, are subsequently performed in a similar manner.

Once the transfer of the entire row of stacks 4 is completed, the advancement of the belt 8 of the trolley 5 along the lifting direction D is actuated so as to prepare a further row of stacks 4 in removal position.

To conclude, the described apparatus allows to feed packaging machines with stacks of cardboard cutouts in a fully automatic manner. In particular, the apparatus transfers one stack at a time, providing a high operating speed which is adequate for the operating speed of conventional packaging machines.

It should be noted that the apparatus allows to directly feed the feed hopper 3 of the packaging machine, with evident advantages, in terms of constructive and operative simplicity, with respect to known devices, wherein the feeding involved with such known devices occurs by interposing conveyor belts.

Conveniently, it is possible to store an appropriate amount of stacks on a fixed ledge 39 from which it is possible to draw during the step of changing the emptied trolleys 5 so as to not interrupt the operation of the machine. The ledge 39 extends below a beam 21 transversely to the transfer direction C.

In the practical embodiment of the invention, the materials employed, as well as the shape and dimensions, may be any according to the requirements.

I claim:

1. Apparatus for feeding a packaging machine with stacks of sheet material, comprising a trolley-like support which is provided with a plurality of supporting means for supporting said stacks of sheet material, said trolley-like support being provided with distribution means for distributing said plurality of supporting means thereon, each of said plurality of supporting means defining an accommodation seat for accommodating an individual one of said stacks of sheet material, said apparatus further comprising a removal and transfer unit which is provided with a movable head and a grip element for gripping each of said individual one of said stacks, said grip element being supported by said head, said head being arrangeable at a selected said accommodation seat and subsequently movable, after said grip element grips said individual one of said stacks, to a feeding station of said packaging machine, said each of said plurality of supporting means having a pair of opposite walls between which is defined said accommodation seat, said distribution means having connected thereto arms which rotatably support said pair of opposite walls, said opposite walls being rotatable about a substantially horizontal axis, said apparatus further comprising means for mutually linearly displacing said pair of opposite walls along a direction of said substantially horizontal axis, thereby said pair of opposite walls being openable for inserting said individual one of said stacks into said accommodation seat and alternatively for removing said individual one of said stacks from said accommodation seat, and additionally said pair of opposite walls being closeable about said individual one of said stacks for support thereof in said accommodation seat.

2. Apparatus according to claim 1, wherein said trolley-like support comprises a frame and said distribution means comprise a belt which wraps around a pair of rollers which are rotatably supported by said frame, said pair of rollers being substantially horizontal and mutually parallel in a vertical plane, said belt being suitable for being actuated by a motor element, said arms being orthogonally connected to said belt.

3. Apparatus according to claim 1, wherein said means for mutually linearly displacing said pair of opposite walls comprise, for each one of said pair of opposite walls, a stem which is fixed orthogonally to said each one of said pair of opposite walls, said stem extending along said direction of said substantially horizontal axis, said means for mutually linearly displacing said pair of opposite walls further comprising a piston which is rigidly associated with said stem, a cylinder for the sliding of said piston rigidly associated with an end of a respective arm, and pneumatic ducts for feeding said cylinder.

4. Apparatus according to claim 1, wherein said head of the removal and transfer unit is mounted at a lower end of a vertical beam which is slidable in a first sleeve which is rigidly associated with a second sleeve which is perpendicular thereto and which is slidable in turn on a cross-member which is supported at its ends by means of respective sliders on a pair of horizontal and mutually parallel beams.

5. Apparatus according to claim 1, wherein said grip element comprises a fork provided with tines which extend downward with respect to said head, said tines being bent at right angles to thereby define substantially horizontal free ends which are arrangeable under each said individual one of said stacks, said grip element further comprising a presser element which cooperates with said fork and which is mounted so as to oscillate in an upward and substantially intermediate position with respect to said tines so as to secure in an upward position each said individual one of said stacks.

6. Apparatus according to claim 1, wherein said feed station is constituted by a hopper which is formed by a frame and a plurality of angular profiled elements which are suitable for guiding each said individual one of said stacks on the frame.

7. Apparatus according to claim 1, further comprising a fixed ledge for storing an appropriate quantity of said stack to be drawn from during the step a changing said trolley-like support.

8. Apparatus for feeding a packaging machine with stacks of sheet material, comprising a trolley-like support which is provided with a plurality of supporting means for supporting said stacks of sheet material, said trolley-like support being provided with distribution means for distributing said plurality of supporting means thereon, each of said plurality of supporting means defining an accommodation seat for accommodating an individual one of said stacks of sheet material, said apparatus further comprising a removal and transfer unit which is provided with means for gripping each of said individual one of said stacks and means for transferring said stacks to a feeding station of said packaging machine, said each of said plurality of supporting means having a pair of opposite walls between which is defined said accommodation seat, said apparatus further comprising means for mutually linearly displacing said pair of opposite walls along a direction of a substantially horizontal axis, thereby said pair of opposite walls being openable for inserting said individual one of said stacks into said accommodation seat and alternatively for removing said individual one of said stacks from said accommodation seat, and additionally said pair of opposite walls being closeable about said individual one of said stacks for support thereof in said accommodation seat.

9. Apparatus according to claim 8, wherein said distribution means comprise a belt rotatable about an upper roller and a lower roller which are supported by said trolley-like support and a plurality of arms which are rigidly connected to said belt, said plurality of arms extending substantially orthogonally from said belt and oscillably supporting said pair of opposite walls of each of said plurality of supporting means for supporting said stacks of sheet material, said means for mutually linearly displacing said pair of opposite walls comprising a pneumatic cylinder connected to an end of each of said arms, a piston arranged in said cylinder, and a stem interconnected between said piston and a respective one of said pair of opposite walls.

* * * * *